US005685220A

United States Patent [19]

Steffen et al.

[11] Patent Number: 5,685,220

[45] Date of Patent: Nov. 11, 1997

[54] APPARATUS FOR PRINTING ON FLAT INDIVIDUAL ARTICLES

[75] Inventors: Volker Steffen, Herford; Horst Heidenreich, Kirchlengern; Norbert Rohwetter, Bünde, all of Germany

[73] Assignee: Werner Kammann Maschinenfabrik GmbH, Bunde, Germany

[21] Appl. No.: 668,026

[22] Filed: Jun. 19, 1996

[30] Foreign Application Priority Data

Jul. 12, 1995 [DE] Germany ..... 195 25 351.5

[51] Int. Cl.[6] ..... B41F 17/00

[52] U.S. Cl. ..... 101/37; 101/231; 101/247

[58] Field of Search ..... 101/36, 37, 216, 101/229, 231, 232, 483, 485, 247, 211

[56] References Cited

U.S. PATENT DOCUMENTS

| | | | |
|---|---|---|---|
| 3,724,370 | 4/1973 | Martin | 101/377 |
| 3,735,697 | 5/1973 | Provan | 101/37 |
| 4,109,572 | 8/1978 | Roulleau | 101/37 |
| 5,350,553 | 9/1994 | GLäser et al. | 264/511 |
| 5,401,457 | 3/1995 | Valyi | 264/511 |
| 5,423,252 | 6/1995 | Yamamoto et al. | 101/37 |
| 5,514,240 | 5/1996 | Hagiiiri-Teiirani et al. | 156/250 |
| 5,584,246 | 12/1996 | Steffen et al. | 101/485 |

*Primary Examiner*—Eugene H. Eickholt

*Attorney, Agent, or Firm*—Seidel Gonda Lavorgna & Monaco, PC

[57] ABSTRACT

An apparatus for printing on individual articles comprises a printing cylinder and an impression cylinder. When printing on articles with a cavity for accommodating for example a chip the wall region of the card which delimits the cavity has to be supported for printing on the side opposite the cavity. For that purpose the impression cylinder has a support portion engageable into the cavity when the article passes the impression cylinder. For converting the apparatus between printing procedures of different kinds the support portion is displaceable between an inoperative position and an operative position by displacement of the impression cylinder in the direction of rotation thereof so that in one basic angular position the support portion does not come into contact with the articles passing the impression cylinder during the printing operation and in another basic angular position the support portion engages into the cavity of the article.

14 Claims, 7 Drawing Sheets

FIG.3
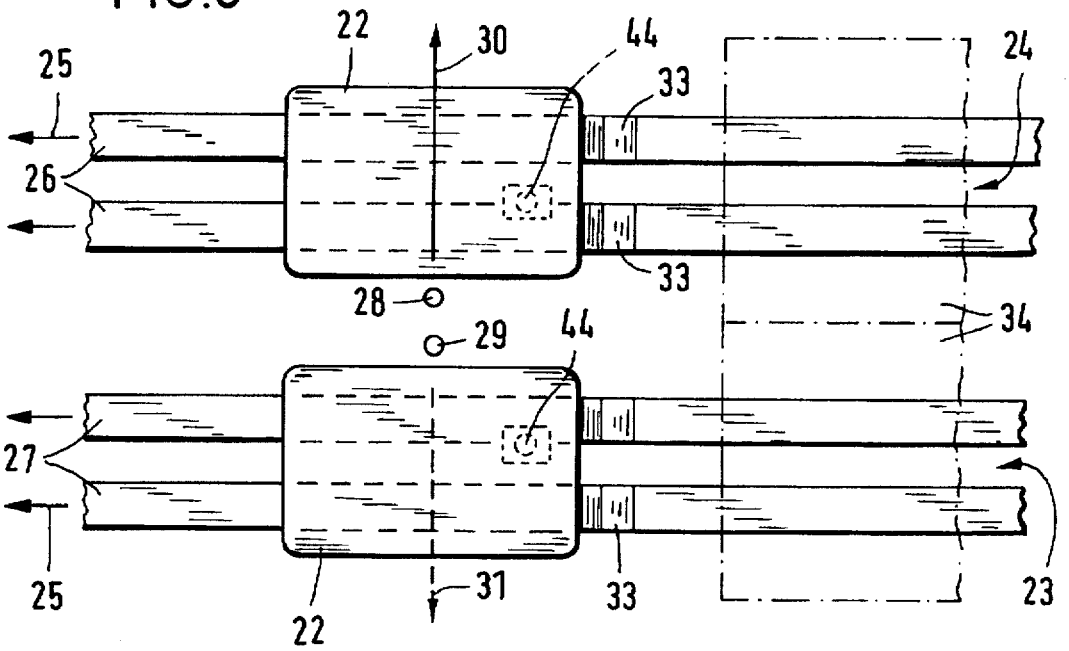
FIG.4
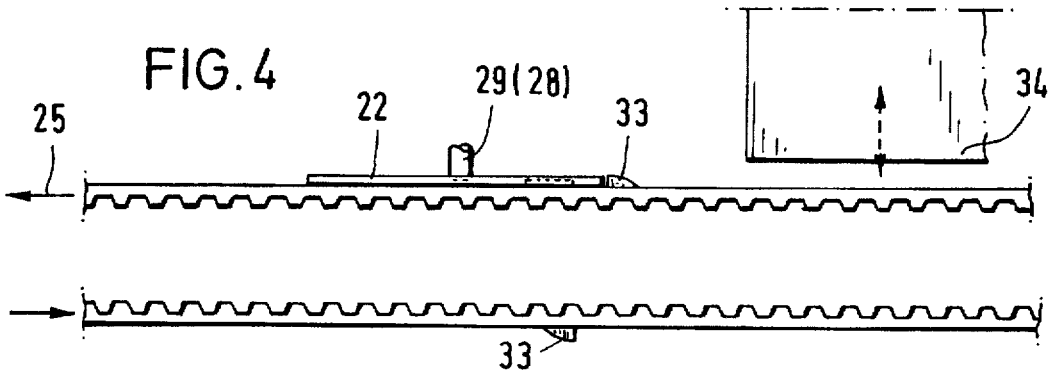
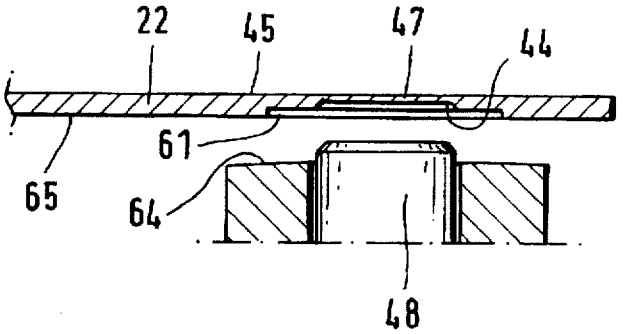
FIG.5

FIG.10
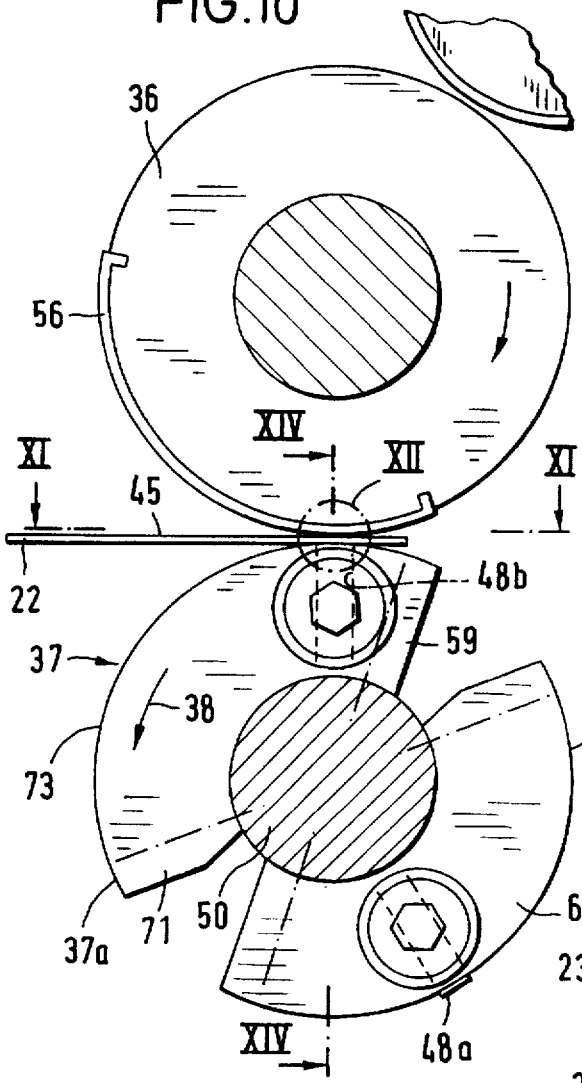
FIG.11
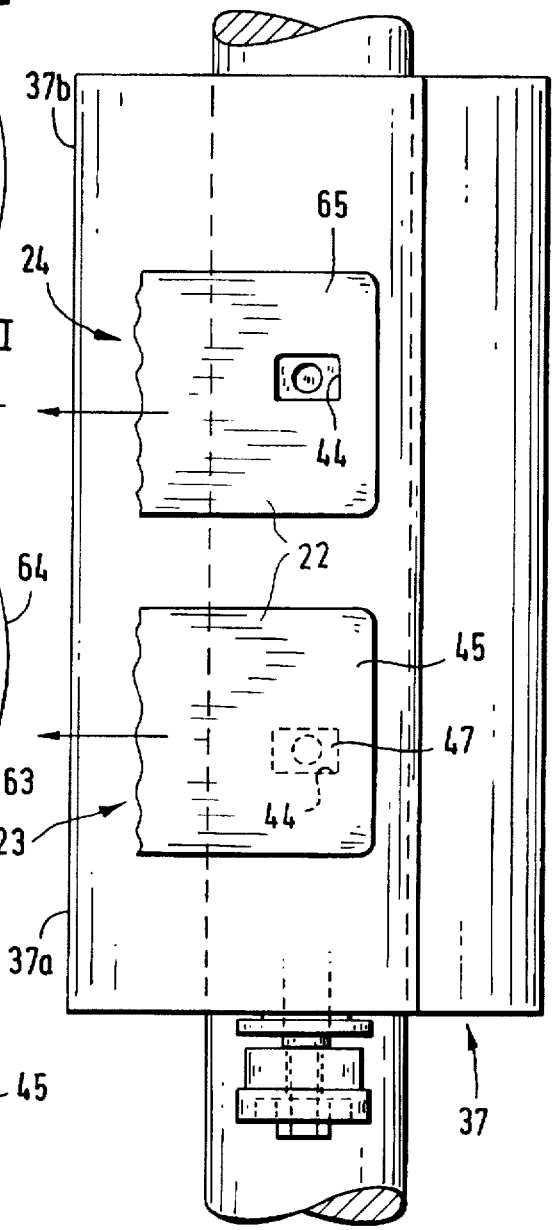
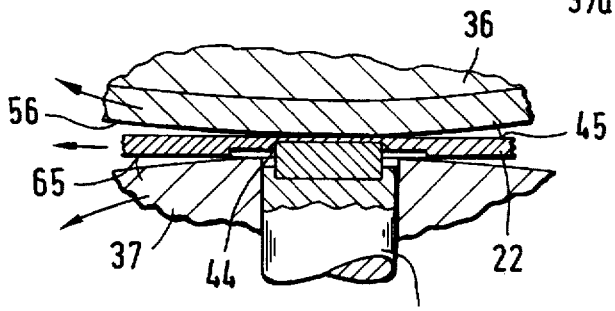
FIG.12

APPARATUS FOR PRINTING ON FLAT INDIVIDUAL ARTICLES

FIELD OF THE INVENTION

The present invention concerns an apparatus for printing at least once on flat individual articles.

The term articles in the present specification includes for example cards and similar articles which may be provided with at least one cavity for accommodating a chip or another element or component. Typical examples of such articles that may be mentioned here are telephone cards whose extent in the plane of the surface to which printing is to be applied is substantially greater in the transverse direction thereto.

BACKGROUND OF THE INVENTION

When dealing with articles of the above-indicated kind, which are provided with a cavity therein, it is necessary during the operation of printing on the surface of the article which is opposite to the cavity, for the article to be supported at the side having the cavity, at least in the region thereof in which the wall defining the cavity is of its smallest thickness. If that were not the case, that is to say without providing a support action of that kind, that region would suffer from elastic deformation under the pressure which occurs in the printing operation, with the consequence that no printing is applied to that region or at least the print image produced in that region would be one that would not satisfy the usual requirements in terms of quality.

It is therefore conventional practice for at least a part of the wall defining the cavity in the article to be supported during the printing operation by a support member which is arranged to engage into the cavity in order thereby to prevent deformation of that region under the effect of the pressure occurring in the printing operation, at least to such a degree that perceptible impairment of the quality of the print image in that region does not occur. Such a support member is frequently of a pin-like or ram-like configuration. At its free end which comes into contact with at least a part of the wall defining the cavity, the support member is frequently of a substantially round cross-section. It is however also possible to adopt other cross-sections in dependence on the shape of the cavity or the region to be supported.

In many cases, in particular when using offset printing, the article is held during the printing operation at a backing or impression cylinder whose peripheral surface is arranged at a spacing from the surface of the printing cylinder which carries the printing ink to be transferred on to the article, which spacing approximately corresponds to the thickness of the article to be printed upon, having regard to the requirements involved in the printing procedure. However the use of an impression cylinder for holding and supporting the article is not restricted to the use of offset printing. Other printing processes frequently also involve supporting the article by an impression cylinder during the printing operation. Therefore, when applying printing to cards and other articles which are provided at least at one side with at least one cavity whose wall defining same must be supported by a support member, it is necessary when using at least one support member for the support member to be mounted on the impression cylinder, in which case the support member must be disposed on the peripheral surface of the impression cylinder in a given orientation relative to the transfer or offset surface of the printing cylinder, as when the actual card is oriented relative to the transfer surface of the printing cylinder, as is usually required, that also establishes a given position for the cavity relative to the transfer surface, which therefore also determines the rotational position of the support member.

As the articles which are involved here, for example telephone cards or credit cards, normally have printing applied thereto on both sides thereof, although frequently only one side of the article has a cavity, it is necessary for the support member to be moved into an inoperative position when applying printing to the side which has the cavity, as, on the above-mentioned assumption that only one side of the article is provided with a cavity, the side of the article which bears against the impression cylinder does not have a cavity which would receive the support member. A corresponding consideration also applies when making a change for example from a series of cards with a cavity to a series of cards without a cavity. That is usually effected by the support member which is normally radially displaceably mounted in the impression cylinder being axially displaced in the longitudinal direction from its operative position in which it projects relative to the peripheral surface of the impression cylinder, towards the axis of rotation of the impression cylinder, to such an extent that a card which in the printing operation passes the region of the peripheral surface in which the support member is disposed does not come into contact with the support member, with the disadvantageous consequences that that would entail. That way of adapting the arrangement to the respective operating circumstances involved is very time-consuming as in particular the step of setting the support member in its respective operative axial position is an operation that must be carried out with a high degree of accuracy so that the position of the end region of the support member, which engages into the cavity, is accurately adapted to the topography of the cavity and in particular the depth thereof. Accordingly, in the present machines, a comparatively long period of time is required for conversion thereof from one series of cards to another or for converting a machine from printing on one side of an article to printing on the other side, while in addition there is the danger that, if the setting adopted is inaccurate, the machine firstly produces only waste and reject articles and therefore further time is additionally lost in producing the correct setting. That is not least disadvantageous for the reason that the articles which are involved here, for example the telephone cards as already mentioned above, are often to be printed upon in very short series or runs, that is to say with a small number of cards in each series. It will be clear therefore that in that situation the time involved in converting the equipment is a particularly significant factor.

SUMMARY OF THE INVENTION

An object of the present invention is to provide an apparatus for printing on flat individual articles, which is so designed that conversion of the apparatus to different operational requirements in dependence on the nature of the respective article to be printed upon and/or the nature of the respective side of an article to be printed on, if necessary, can be effected quickly and if necessary also by a temporary worker or a less skilled operator, with the necessary degree of accuracy. Another object of the present invention is to provide an apparatus for printing on flat individual objects, which is so designed as to permit conversion thereof to different operating conditions in dependence on the respective articles, even when two or more articles are to be simultaneously printed upon and for that purpose are passed over a common impression cylinder.

A further object of the present invention is to provide an apparatus for printing on flat individual articles whose extent perpendicularly to a substantially flat surface thereof which is to be provided with the printing is generally relatively small, which affords a high level of output and highly accurate printing results at a high throughput rate, while being such that it can be rapidly converted from one article format or configuration to another.

In accordance with the principles of the present invention, the foregoing and other objects are achieved by an apparatus for printing on individual articles whose extent perpendicularly to the substantially flat surface which is to be provided with the printing is generally relatively small, the apparatus comprising a printing cylinder and an impression cylinder. In at least one longitudinal portion the impression cylinder is provided with at least one substantially radial support portion which projects beyond the peripheral surface of the impression cylinder and which when printing on articles which are provided with a cavity and whose side having the cavity is towards the impression cylinder, in its operative position in the printing operation, engages into the at least one cavity of the respective article passing the impression cylinder, and supports its region defining the cavity. The impression cylinder is rotatably connected to a drive means driving sane and the printing cylinder, by way of a disengageable coupling or clutch having at least first and second coupling portions. When the coupling is disengaged the impression cylinder is set in respect of its rotary angular position relative to the rotary angular position of the printing cylinder. The coupling portions are provided with connecting means in such a way that the coupling portions can be non-rotatably connected together in at least first and second predetermined basic angular positions, and those basic angular positions correspond to an inoperative or an operative angular position of the at least one support portion. The diameter of the impression cylinder is so selected that provided in the at least one longitudinal portion of the impression cylinder which is provided with at least one support portion is a peripheral surface region which in the peripheral direction is of such a dimension that an article can pass the impression cylinder on that region of the peripheral surface without in that case coming into disturbing contact with the at least one support portion.

As will be seen in greater detail from a description hereinafter of a preferred embodiment of the apparatus according to the invention, when printing on the side of the article which is opposite to the cavity, the impression cylinder is to be so set in respect of its angular position that the support portion engages into the cavity disposed on the side of the article which is towards the impression cylinder. When printing is being applied to the other side of the article, that is to say the side which has the cavity, the impression cylinder is so set in respect of its angular position relative to the printing cylinder that the article only comes into contact with a peripheral region of the surface of the impression cylinder, which does not have a support portion. This means that although the support portion is provided on the impression cylinder and can also project relative to the peripheral surface thereof, because of the selected setting in respect of the angular position of the impression cylinder that support portion passes the region of the path of rotational movement of the peripheral surface of the impression cylinder which is opposite to the printing cylinder, as long as there is no article such as a card between the impression cylinder and the printing cylinder. That means that, in the event of the presence of a support portion for the region of a cavity in a given cross-sectional plane of the impression cylinder, the peripheral surface thereof must be of such a dimension in the peripheral direction that it includes a smooth region without a support portion plus a region in which the support portion is provided. In that respect however there is no need for the total periphery of the impression cylinder to amount to double the length of an article in the direction of movement thereof. On the contrary, when applying printing to an article when the support portion engages into the cavity, the major part of the article can be rolled against a part of the peripheral region of the impression cylinder which also serves as a support surface when applying printing to the side of the article which has the cavity. In that respect, the amount by which the peripheral surface must be greater than corresponds to the length of an article in the direction of movement thereof during the printing procedure may also depend on the position of the cavity within the article and in particular the distance of the cavity from the respective end edge of the article, and naturally also the number of support portions in the same cross-sectional plane of the impression cylinder.

The invention further affords the possibility of at least two articles being simultaneously printed using the same impression cylinder. For that purpose, in at least first and second longitudinal portions, the impression cylinder is provided with at least one respective support portion in such a way that both portions are disposed at a longitudinal spacing from each other substantially in the same radial plane which extends parallel to the axis of rotation of the impression cylinder and a common rotary angular position in respect of the connecting means of the coupling portions is associated with the two support portions. Those two support portions are therefore arranged jointly either in an inoperative position or in an operative position. In the latter case, on two articles which are printed at the same time, the side thereof which is opposite the cavity would be printed upon and thus the cavity region thereof would be supported.

Furthermore, in its one longitudinal portion, the impression cylinder may be provided with a further support portion, wherein the spacing in the peripheral direction between the two support portions of the same longitudinal portion of the impression cylinder is so selected that the further support portion is disposed in a peripheral region of its longitudinal portion which corresponds to a peripheral region in the other longitudinal portion, in which an article can pass that longitudinal portion of the impression cylinder without coming into disturbing contact with a support portion which is possibly disposed in that longitudinal portion of the impression cylinder. It is possible to associate with the angular position of the impression cylinder, in which the further support portion assumes its operative position, a further rotary angular position of the connecting means of the coupling portions. As the radial plane which extends parallel to the axis of rotation of the impression cylinder and which is defined by the further support portion does not contain a second support portion, an angular positioning of the impression cylinder with that one further support portion in its operative position would mean that one of the two simultaneously printed articles is assigning a position in which the side thereof having the cavity lies against the impression cylinder, while in the case of the second article the cavity is on the other side, that is to say the side which is towards the printing cylinder. Different requirements therefore apply in respect of the two articles. Depending on the respective factors and parameters involved that can serve entirely to avoid conversion of the apparatus, which would otherwise be required.

Further objects, features and advantages of the present invention will be apparent from the following description of a preferred embodiment.

BRIEF DESCRIPTION OF THE DRAWINGS

FIG. 3 is a view on an enlarged scale of the region identified by III in FIG. 2, FIG. 4 is a side view of the FIG. 3 structure, FIG. 5 shows a part of a card with a cavity for a chip and the support post or punch associated with the cavity, FIG. 10 is a view in section taken along line X—X in FIG. 8, FIG. 11 is a view of the impression cylinder approximately along the line XI—XI in FIG. 10, FIG. 12 is a view of the region indicated at XII in FIG. 10.

DESCRIPTION OF THE PREFERRED EMBODIMENT

As indicated above, described hereinafter as a preferred embodiment of the present invention is a machine for applying printing to a flat individual article whose extent perpendicularly to the substantially flat surface which is to be provided with the printing is generally relatively small, for example in the form of a telephone card or a like card, provided with a cavity for accommodating a chip.

Figure 1:
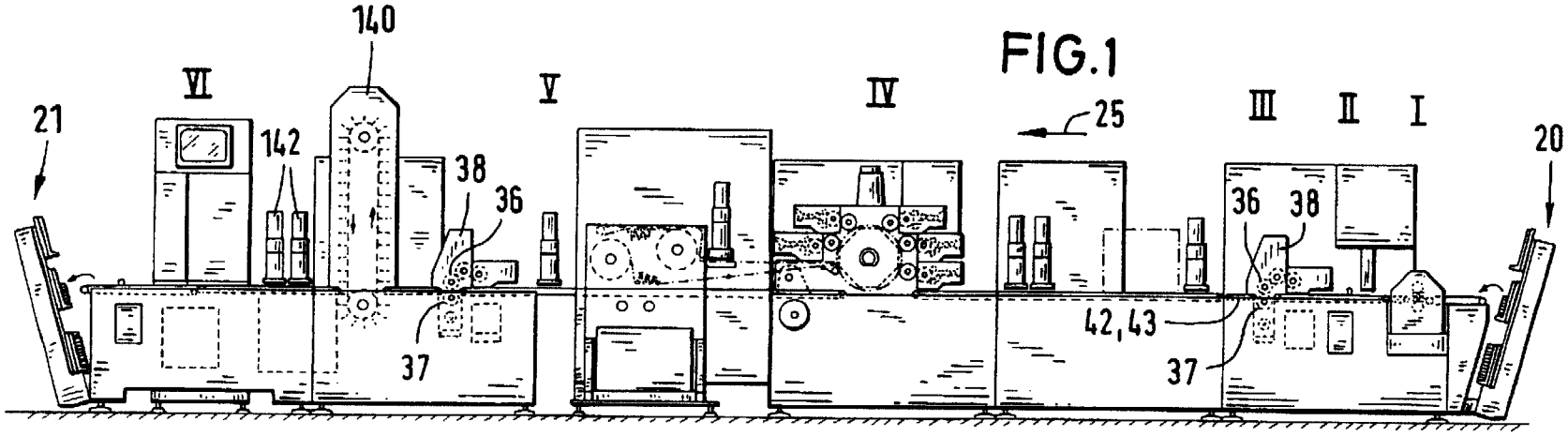
FIG. 1 is a side view of an apparatus according to the invention in the form of a machine for printing on telephone cards or similar cards which are provided with a chip.
Figure 2:
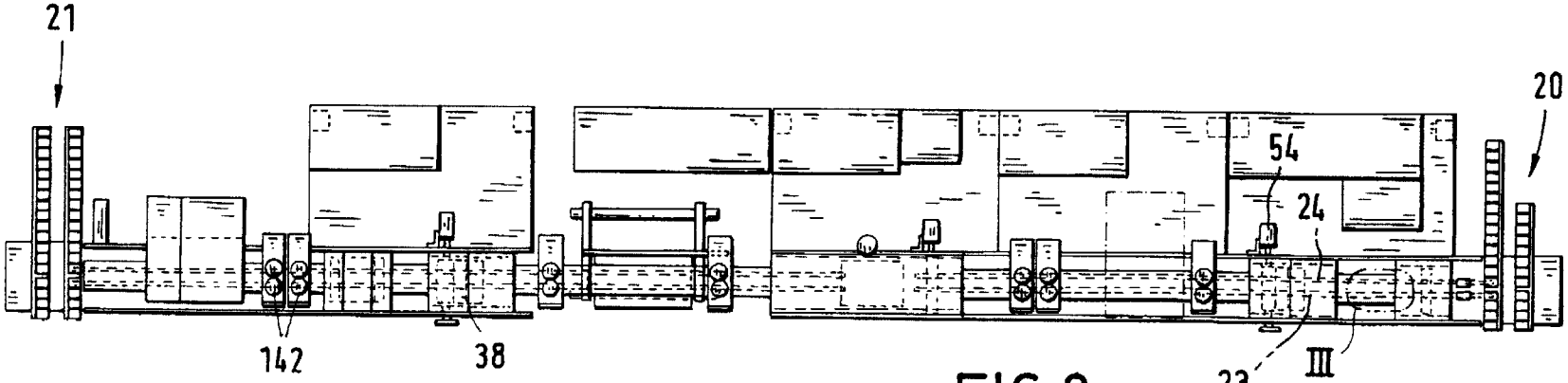
FIG. 2 is a plan view of the FIG. 1 machine.

Referring firstly to FIGS. 1 and 2, it will be seen therefrom that the illustrated machine is of a substantially linear construction such that the articles to which printing is to be applied are supplied at one end from a magazine device 20 of the machine and, after passing through a series of treatment stations, are received at the other end, at the left in FIGS. 1 and 2, by a collecting device 21 and from there are passed for further treatment or use. As, in the illustrated embodiment, two articles are respectively transported in pairs through the machine and subjected to processing therein, the machine is provided with first and second transport paths 23, 24 which each have a plurality of successive transport and handling devices and which bridge over the spacing between the two devices 20 and 21.

After the articles have been transferred in their respective pairs from the magazine device 20 to the transport paths 23 and 24, the articles which in this case are more particularly in the form of flat cards 22 such as telephone cards or credit cards firstly pass through a cleaning station as indicated at I in FIG. 1 in which for example dust and the like is removed therefrom. This station involves known devices and operating steps which do not constitute part of the present invention and which therefore do not need to be described in greater detail herein for that reason.

Reference numeral II in FIG. 1 denotes a checking station which is downstream of the cleaning station I in the transport direction 25, the station II ascertaining whether a respective card is present in the positions prescribed therefor on the two transport paths 23 and 24 which in this case are formed by two pairs of toothed belts as indicated at 26 and 27 in FIGS. 3 and 4, and whether in addition the two cards are in the correct position. If the cards are each provided with a cavity as indicated at 44 in FIG. 5, the print image which is to be applied to the respective card and which may possibly also contain data must generally be arranged and oriented in a specific fashion relative to the cavity. In that respect, for example in the one transport path, the side of a card which does not have a cavity can have printing applied thereto while in the other transport path it is the side of the card which has a cavity that receives printing. If one of the relevant requirements for this procedure to take place is not met in one of the two transport paths 23 and 24, two substantially vertically extending ejector pins indicated at 28 and 29 in FIGS. 3 and 4 and disposed between the two transport paths 23 and 24 are displaced in the direction of the respective arrows 30 and 31, that is to say approximately perpendicularly to the transport direction, whereby both cards or, if only one of the two cards is present, the card that is so present, are or is ejected. This always guarantees that there are either two cards correctly arranged and oriented on the two pairs of toothed belts 26 and 27 or that there is no card at all, and the positions intended for the cards on the two pairs of toothed belts 26 and 27 are thus empty. The position assumed by the two cards relative to the respective pairs of toothed belts 26 and 27 is determined by entrainment members which are indicated at 33 in FIGS. 3 and 4 and which are mounted on the toothed belts 26 and 27 and which engage behind the respective cards positioned thereon, at their edges which are the trailing edges in the transport direction 25.

Figure 6:
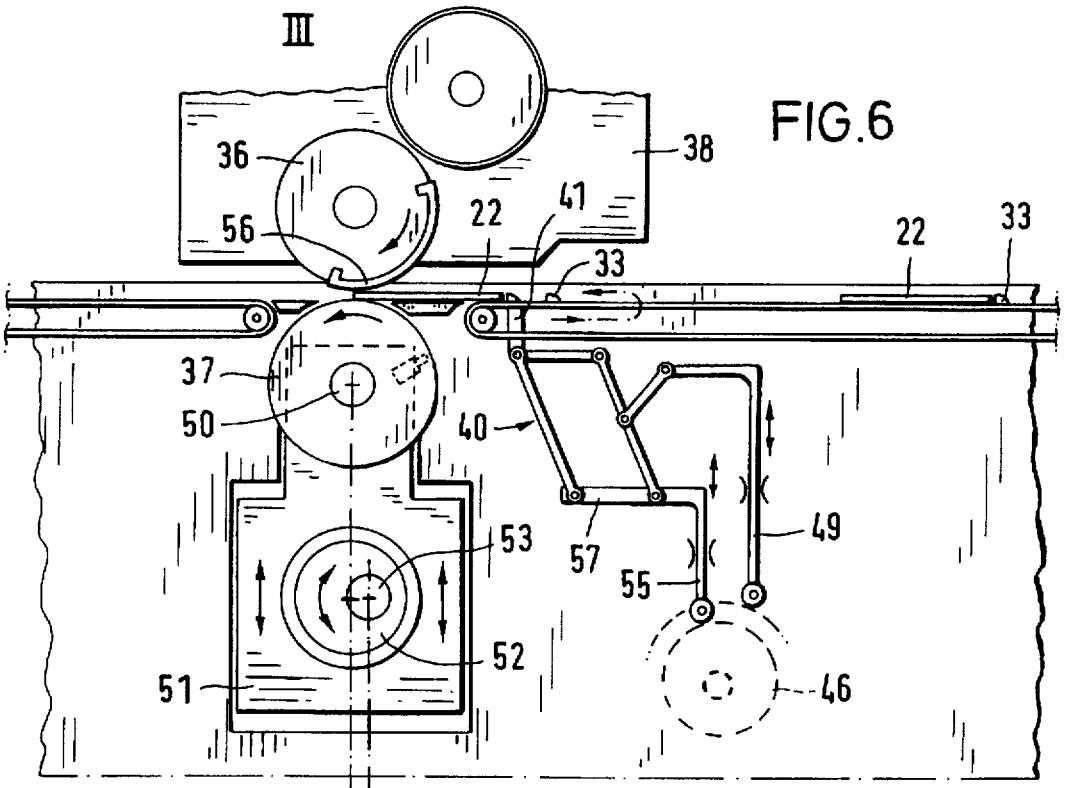
FIG. 6 is a side view showing a section of the first printing station on an enlarged scale.
Figure 7:
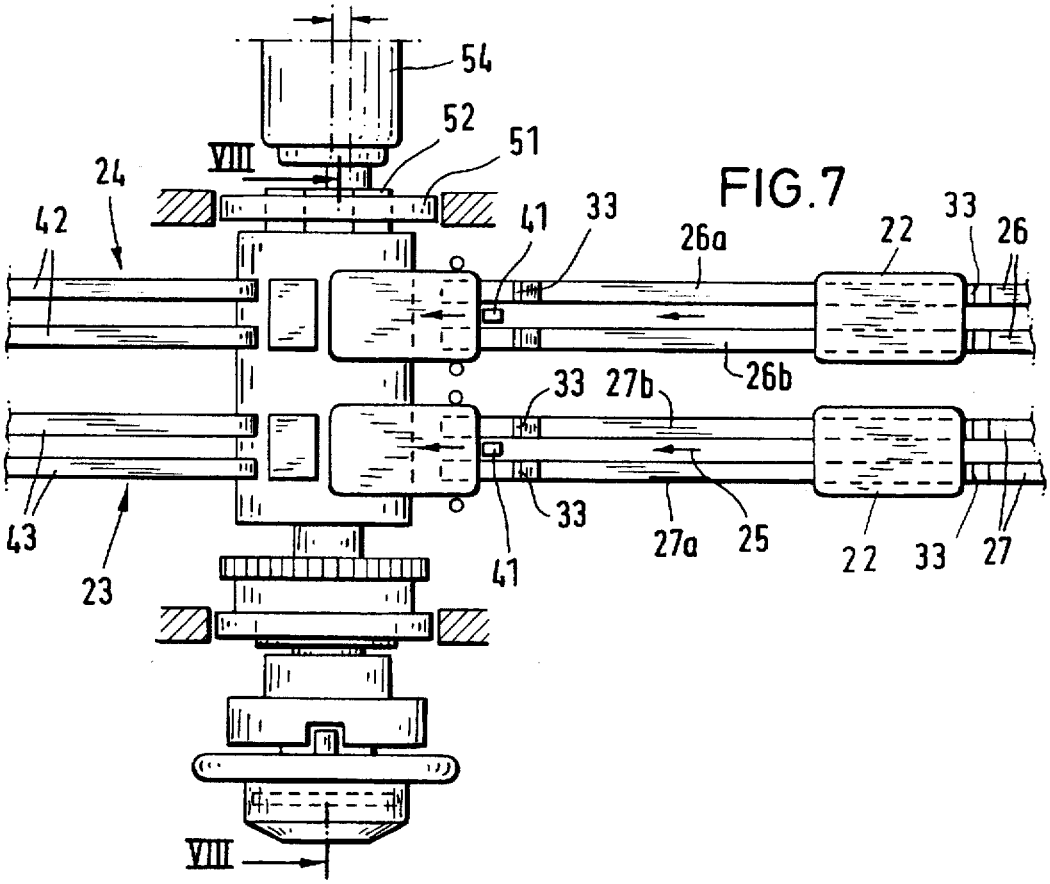
FIG. 7 is a plan view of the FIG. 6 structure.

The ejector pins 28 and 29 are actuated in dependence on the result of a checking operation performed by a monitoring device 34 provided with suitable sensors. The detection and control devices required for that procedure can be of any suitable known configuration and therefore do not need to be described in greater detail herein. In general both the checking operation using the device 34 and also ejection by actuation of the ejector pins 28 and 29 are effected during the continuous transportation movement of the cards. Referring now also to FIGS. 6 and 7 the treatment station which follows in the transport direction 25 and which is indicated at III in FIG. 1 is a single-ink printing station in which for example a primer is applied to the cards using an offset printing process. Arranged beneath the blanket or printing cylinder 36 which offsets or transfers the ink on to the two respective cards in the printing station III is an impression cylinder 37 which holds and supports the two cards during the printing operation, the cards being passed through between the two cylinders 36 and 37 in the usual manner in the printing procedure. The printing mechanism 38 of the printing cylinder 36 is of the usual design configuration so that there is no need for this to be described in greater detail herein.

FIG. 6 in particular shows that associated with the printing station III is an additional transport device 40 having first and second entrainment members 41, each of which is associated with a respective one of the two pairs of toothed belts 26 and 27 in such a way that a respective entrainment member, in its raised position, engages between the two toothed belts 26*a*, 26*b* or 27*a*, 27*b* of the respective pairs 26 and 27 and comes to bear behind the card 22 supported thereon and pushes it towards the two cylinders 36 and 37, in leading relationship relative to the circulating pair of toothed belts 26 and 27, until the card, at its edge which leads in the transport direction 25, is engaged by the two cylinders 36 and 37 and is moved in the course of the printing operation by the cylinder 36 in the direction of one of two pairs of toothed belts 42 and 43 which are disposed at downstream positions. By virtue of the selected form of drive arrangement, by way of two levers 49 and 55 which are movable upwardly and downwardly by a cam disk 46 and a parallelogram assembly 57 which carries the entrainment members 41, the entrainment members 41 perform reciprocal movements substantially in the transport direction 25 and in the opposite direction thereto. In the course of the return movement in opposite relationship to the transport direction 25, the entrainment members 41 are disposed below the level of the cards 22 carried on the pairs of toothed belts 26 and 27 in order then at the end of the return movement to assume the upper position shown in FIGS. 6 and 7 in which they engage behind the cards 22 of the following pair and advance them in an accelerated motion towards the two cylinders 36 and 37, as can be seen in particular from FIGS. 6 and 7 in which the two cards engaged by the entrainment members 41 are transported in the transport direction 25 more rapidly than corresponds to the speed of the entrainment members 33 of the pairs of toothed belts 26 and 27. In that respect the speed of the entrainment members 41 is such that the two cards of the pair are at the same time oriented relative to the printing blanket 56 of the rotating printing cylinder 36 in the manner required for offset or transfer of the printing ink or the print image. At the same time that also involves alignment relative to the impression cylinder 37, the need for which will be apparent from the description hereinafter. The drive for the entrainment members 41 is desirably derived from the drive for the two cylinders 36 and 37 in order thus positively to provide the condition of synchronism, which is required for the alignment procedure, in respect of the movements of all co-operating elements.

Figure 8:
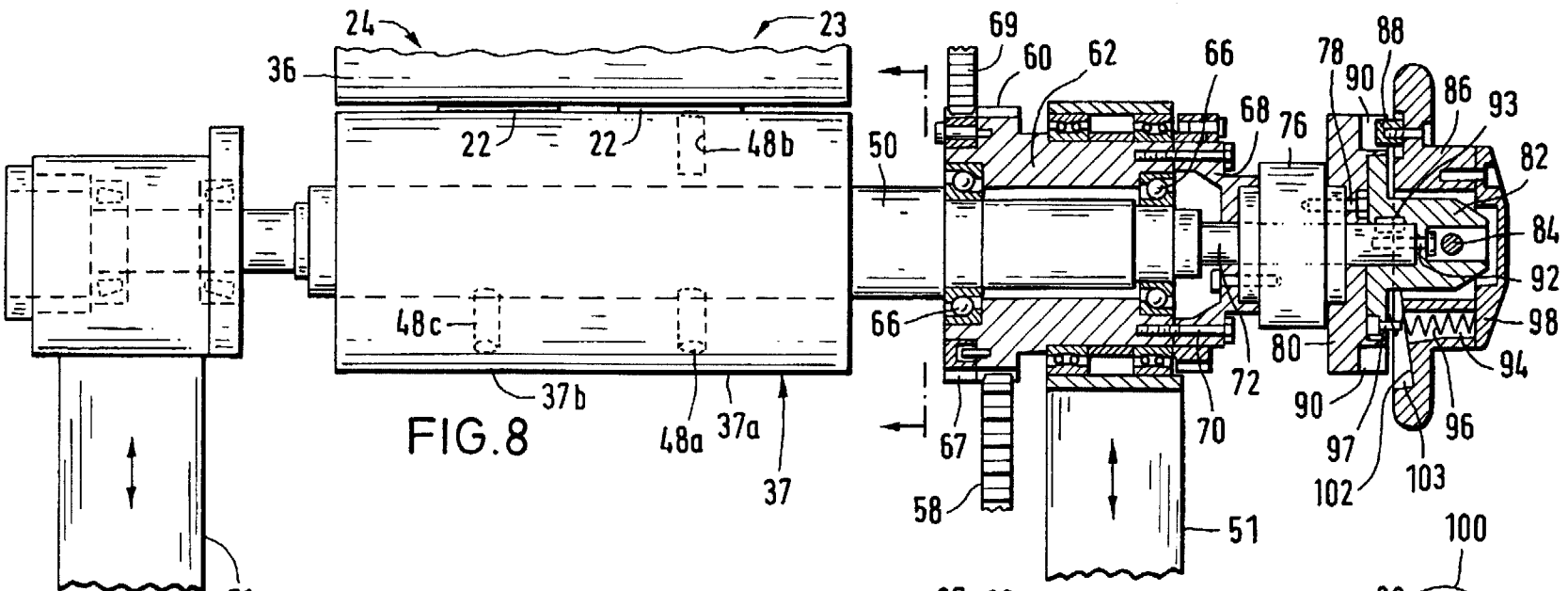
FIG. 8 is a view in section taken along line VIII—VIII in FIG. 7.

Looking still at FIGS. 6 and 7 reference numeral 50 denotes a shaft which carries the impression cylinder 37 and which is mounted in a holder 51 which in turn is carried by a shaft 52 rotatably mounted in the holder 51. The shaft 52 is connected to the shaft 53 of an electric stepping motor 54, but the shaft 53 is arranged eccentrically with respect to the shaft 52 with the result that rotation of the shaft 52, produced by operation of the motor 54, produces, in dependence on the direction of rotation, an upward or a downward movement of the holder 51 which is guided on the machine frame structure, and therewith the shaft 50 with the impression cylinder 37. FIG. 8 shows how the shaft 50 is mounted in the holder 51 at its two end regions which project relative to the impression cylinder 37, with the interposition of suitable rolling bearings. By virtue of the described arrangement of the parts and the co-operation thereof, it is possible for the impression cylinder 37 to be displaced by suitable actuation of the motor 54 into a position in which it is at a spacing from the printing cylinder 36, which is sufficiently large to prevent contact between the two cylinders, in particular between the printing blanket portion 56 on the printing cylinder 36 and the peripheral surface of the impression cylinder 37 and/or the punches or posts 48*a, b, c* of the impression cylinder 37, even when there is no pair of cards disposed for a printing operation between the two cylinders 36 and 37. The motor 54 is controlled by the monitoring device 34 in the station II in such a way that, whenever a pair of cards is missing, whether it is because the missing pair of cards did not from the outset move into the two transport paths 23 and 24 or whether it is because the pair of cards had been ejected by the ejector pins 28 and 29 for whatever reasons that may apply, the impression cylinder 37 is moved downwardly as soon as the empty positions corresponding to the two missing cards move into the printing station III.

In the cases in which the cards 22 to which printing is to be applied are provided with a cavity as indicated in particular at 44 in FIG. 5 for accommodating a chip or the like, it is necessary that, during the operation of printing on the surface 45 of the card 22, which is opposite the cavity 44, the card is supported at the side having the cavity 44, at least in a region 47 in which the wall defining the bottom of the cavity 44 is at its smallest thickness. For that purpose a support member in the form of a post or punch 48 is employed. Such a punch 48 is shown in FIG. 5 at a spacing from the card 22, for the sake of enhanced clarity of the drawing. The punch 48 projects somewhat relative to the surface 64 which holds the card to be printed upon and which may be the surface of the impression cylinder 37, so that, when a card 22 is disposed on the surface 64, the punch 48 engages into the cavity 44 in the card and supports the region 47 thereof during the operation of applying printing to the surface 45. In that respect it is generally sufficient for only the central region 47 to be supported. There is generally no need for the regions 61 which adjoin the central region 47 in an outward direction to be supported in order to achieve a good print image in the entire region 47, although it will be appreciated that it is possible for at least the end portion of the punch 48, which engages into the cavity 44, to be of a cross-section and a topography which are matched to the size and topography of the entire cavity 44.

While FIG. 5 only shows the association of the support surface 64 and the punch 48 with the card 22 and its cavity 44, FIGS. 10 and 11 in particular show the arrangement of the punches in the impression cylinder 37. As, in the embodiment illustrated in the drawing, the articles to be printed upon are fed in pairs along the transport paths 23 and 24 and the two articles of each pair are simultaneously printed upon, the impression cylinder 37 is of such a design and arrangement, as can be seen in particular from FIG. 11, that it has two longitudinal portions 37*a* and 37*b* and the longitudinal portion 37*a* is associated with the transport path 23 and the longitudinal portion 37*b* is associated with the transport path 24. It will be appreciated in that respect that it is a prerequisite that the printing cylinder 36 with printing blanket 56 is also so arranged and of such dimensions that the printing blanket or the printing blanket portions can receive two applications of ink in side-by-side relationship in the axial direction of the printing cylinder 36 and can then transfer same to the respective cards between the printing cylinder 36 and the impression cylinder 37.

As the apparatus is to be as versatile as possible in terms of use thereof, the endeavour is to provide that, depending on the respective requirements involved, a surface 45 which is opposite the cavity 44 (see FIG. 5) or a surface 66 having a cavity 44 is printed upon, in each of the two transport paths 23, 24. A further option in this respect may involve printing on the surface 45 which is opposite to the cavity 44 in the one transport or printing path, and printing on the surface 66 which has the cavity 44, in the other transport path, as can be seen for example from FIGS. 3 and 11. The last-mentioned option may be a matter of attraction for example when the articles have to be printed upon, on both sides, and one side is firstly printed upon in one transport path and thereafter the other side of the article is printed upon in the other transport path. That has the particular advantage that conversion of the machine when changing from one side of the cards to the other is now made redundant.

Those different possible uses of the apparatus also require corresponding adaptive modifications in the region of the printing mechanism of the station III and any other printing stations that may be provided, having an impression cylinder, as in the first-mentioned case, that is to say when printing on the surface 45 which is opposite the cavity, a respective punch must be provided in both transport paths, and thus also in both longitudinal portions 37*a*, 37*b* of the impression cylinder, for the two respective articles which are to be printed upon at the same time, each of said punches supporting at least a part of the wall region 47 defining the cavity 44 during the operation of printing on the wall region 47. In the second-mentioned case in which the card is arranged in each of the two transport paths in such a way that the surface which is towards the impression cylinder does not have a cavity, there is no need for a punch so that all punches have to be moved into a position in which they do not come into contact with the cards. In the third case, in the region of the one transport path in which printing is to be applied to the respective surface 45 which is facing away from the cavity 44, the corresponding longitudinal portion of the impression cylinder 37 must be provided with a punch which engages into the cavity in the printing procedure, whereas in the longitudinal portion of the impression cylinder 37 which is associated with the other transport path, there is no need to support the wall region of the article which is weakened by virtue of the presence of the cavity 44, and therefore there is also no punch disposed in an operative position.

In order to minimize the conversion times which are required for example when changing over from one series of articles to another series, and having regard to the modifications that are involved therewith in terms of the requirements relating to printing on the articles in the two transport paths, the portion 37*a* of the impression cylinder which is part of the transport path 23 is provided with two punches 48*a*, 48*b* which are arranged substantially radially in the same cross-sectional plane and which are at a spacing from each other in the peripheral direction, whereas the other portion 37*b* of the impression cylinder 37, with which the transport path 24 is associated, is provided only with one punch 48*c* which is arranged parallel to the punch 48*a*, that is to say extending in the same plane which passes through the axis of rotation, for the articles in the transport path 23. The diameter of the impression cylinder 37 and the spacing in the peripheral direction between the two ends of the punches 48*a*, 48*b*, which ends project relative to the peripheral surface 64 of the impression cylinder 37, are so selected that in the printing operation an article can pass a peripheral region 73 between two punches 48*a* and 48*b* without its movement between the cylinders 36 and 37 being influenced or adversely affected by the two punches 48*a* and 48*b*. In practical terms this will mean that the peripheral region 73 of the surface of the impression cylinder 37 between the two punches 48*a* and 48*b* is at least as long as the dimension of the article in the transport direction 25.

Figure 13:
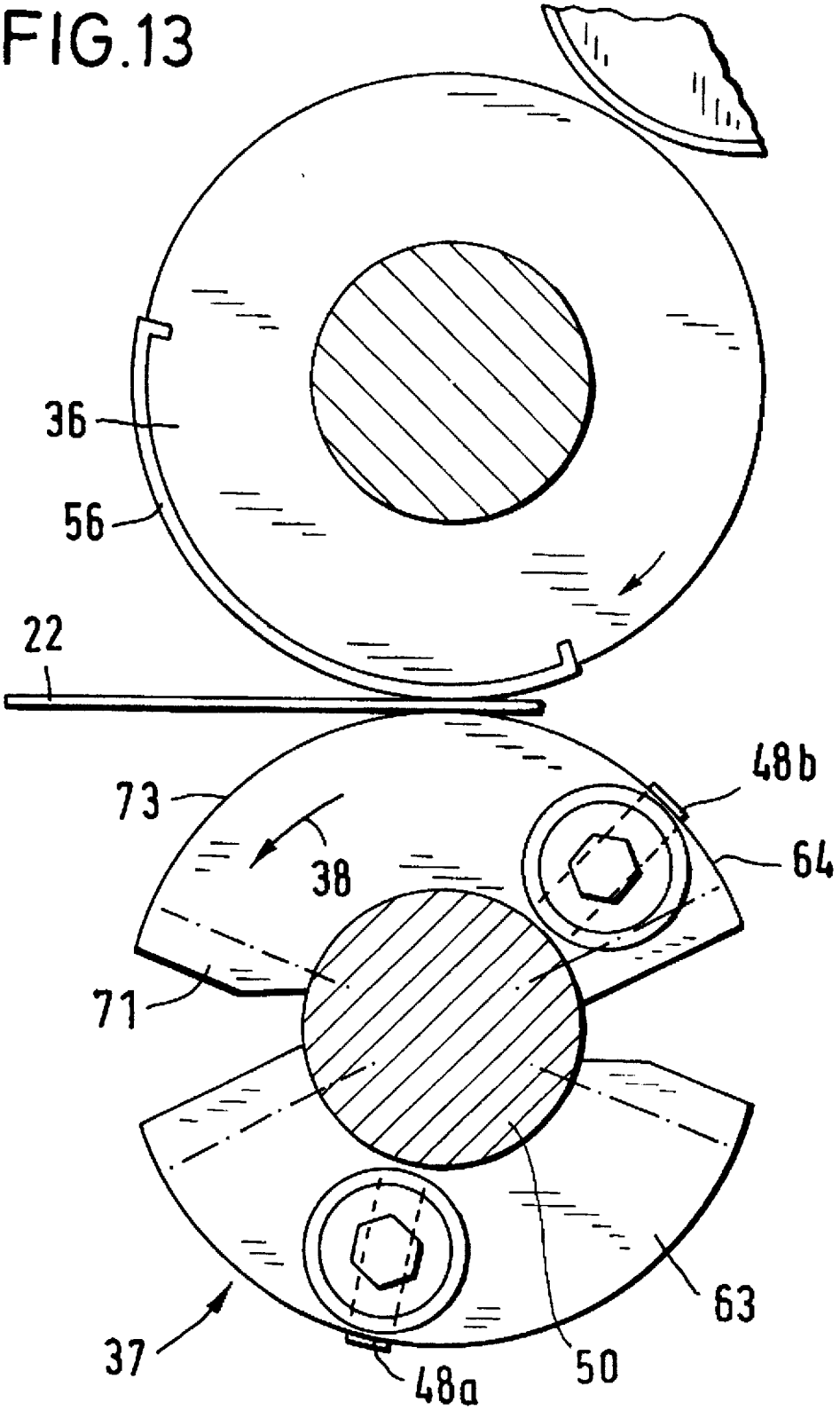
FIG. 13 is a view corresponding to FIG. 10 with the impression cylinder in another basic position.

It will be seen therefrom that, with suitable relative setting of the impression cylinder 37 with respect to the printing cylinder 36, in the printing operation the articles can pass the impression cylinder 37 on both longitudinal portions 37*a*, 37*b* without coming into contact with one of the two punches 48*a*–*c*. That setting of the impression cylinder 37 relative to the printing cylinder 36 is shown in FIG. 13 which clearly indicates that the card 22 between the two cylinders 36 and 37, after the printing operation, comes out of engagement with the cylinders before the punch 48*b* which defines the trailing end of the peripheral region 73 in the direction of rotation 38 passes into the apex region, relative to the printing cylinder 36, in which the printing operation takes place. In the phase of operation as shown in FIG. 13 the part of the card 22 which has the cavity is in the apex region between the two cylinders 36 and 37.

Reference will now be made to FIGS. 10 through 12 showing the impression cylinder 37 in a setting position in which the card surface 45 which does not have any cavity and which faces upwardly is being printed upon in the transport path 23 and the card side 65 which has a cavity 44 is being printed upon in the transport path 24. Accordingly the impression cylinder 37 is so set relative to the printing cylinder 36 that only the punch 48*b* in the impression cylinder portion 37*a* which is associated with the transport path 23 comes into engagement with the cavity 44 in the respective article or card to be printed upon, whereas the other two punches, that is to say the punch 48*a* which is arranged in the same cross-sectional plane as the punch 48*b*, and the third punch 48*c* which is associated with the transport path 24 and which is positioned in the same radial plane through the axis of rotation as the punch 48*a* adopt an inoperative position, in the peripheral direction.

If in the printing operation the surface 45 which has a cavity 44 faces towards the impression cylinder 37 in each of the two transport paths 23 and 24, at least a part of the wall region 47 which defines the cavity 44 (see also FIG. 5 in this respect) needs to be supported in both transport paths. In that case it is necessary for both punches 48*a* and 48*c* to assume relative to the printing cylinder 36 a position in which they engage into the cavity 44 in the respectively associated card disposed between the two cylinders 36 and 37. In other words, the card which is disposed in the transport path 23 and which is carried by the portion 37*a* of the impression cylinder 37 is supported in the region of its cavity 44 by the punch 48*a* and the card which is disposed in the transport path 24 and which is supported by the portion 37*b* of the impression cylinder 37 is supported in the region of its cavity 44 by the punch 48*c*. For that purpose the impression cylinder 37 is to be so set in the peripheral direction relative to the printing cylinder 36 that both punches 48*a* and 48*c* are in the position of the punch 48*b* shown in FIG. 10, that is to say at the top apex point of the impression cylinder, when, in the printing operation, the cards 22 pass that apex region with their cavity and there require the additional support afforded by a punch. In that setting the punch 48*b* assumes an inoperative rotational position.

The peripheral region of the impression cylinder 37 which is delimited by two punches 48*a* and 48*b* and which is less than 180° and which does not include the peripheral region 73 is of such a size that the spacing between two punches in terms of an arcuate measurement is sufficiently large to ensure that, when the article co-operates with one of the two punches, it does not come into contact with the respective other punch, as is clearly shown in FIG. 10.

In all cases the speed of transportation movement of the articles in the transport direction which is determined by the entrainment members 41 (see FIGS. 6 and 7) is so set that, at the time at which the respectively inoperatively set punches pass the top apex point of the impression cylinder 37, the next following cards are not yet in the region of the two cylinders 36 and 37. The spacing between two successive cards is essentially determined by the time that the printing blanket 56 requires in order to move from a position approximately as shown in FIG. 10 in the course of the rotational movement of the cylinder 36 into the starting position for the next printing operation.

As can be seen from FIG. 10, in the embodiment illustrated the impression cylinder 37 comprises two parts 59 and 63 which are each in the form of a sector portion or shell portion and which are mounted to the shaft 64 releasably for example by means of screws. That kind of configuration is adopted in order to make it easier to fit the punches 48*a*, 48*b* and 48*c* and the associated parts which are still to be described hereinafter, in the impression cylinder 37. Furthermore this design configuration also assists with rapid change of the parts of the impression cylinder, which carry the punches, if that is required when changing from one series of articles to another, because for example the cavities in the articles of one series are positioned differently from those in the articles of the other series.

In the illustrated embodiment the impression cylinder 37 can be set into three basic rotational positions in dependence on the respective parameters involved, that is to say more especially in dependence on the nature and the position of the articles. For that purpose the apparatus affords simple and easily operable adjustability which also makes it possible to find the respectively required position without difficulty and easily connect the impression cylinder to the drive means in that respectively required position relative to the printing cylinder 34.

Figure 9:
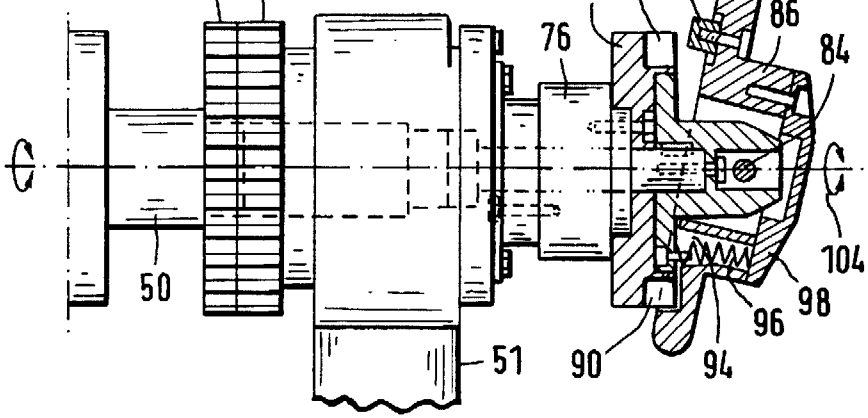
FIG. 9 is a view corresponding to FIG. 8, but with the coupling released.

Referring now also to FIGS. 8 and 9, the printing cylinder 34 and the impression cylinder 37 are driven by way of interposed means to be described hereinafter, by a gear 58 meshing with a gear 60 of a hollow shaft 62 within which a portion of the shaft 50 of the impression cylinder 37 is mounted rotatably by way of rolling bearings 66. A further gear 67 mounted on the hollow shaft 62 drives a gear 69 which is fixedly carried on the shaft of the printing cylinder 36 and rotates same. That can easily ensure a condition of synchronism in respect of the rotational movements of the printing cylinder 36 and the impression cylinder 37.

Fixed to the end of the hollow shaft 62 which is remote from the impression cylinder 37 by way of screw bolts is an intermediate portion 68 which is also of a hollow configuration and which surrounds an extension 72 of the shaft 50 in such a way that the intermediate portion 68 and the extension 72 can also rotate independently of each other. At its side remote from the hollow shaft 62 the intermediate portion 68 is connected by suitable means such as screw bolts 74 to a differential setting unit 76 which is of an annular configuration and which also has a through passage for the extension 72 of the shaft 50. At the end remote from the hollow shaft 62 the differential setting unit 76 is connected by way of screw bolts 78 to a first coupling ring 80 through which the extension 72 of the shaft 64 also extends.

At its free end the extension 72 of the shaft 64 is provided with a holder 82 for a pin 84 which extends perpendicularly to the longitudinal axis of the shaft 64 and the extension 72 thereof and which carries a second coupling ring 86. The coupling ring 86 is non-rotatably connected by way of the pin 84 and the holder 82 to the extension 72 and it is thus also non-rotatably connected by way of the shaft 50 to the impression cylinder 37. The above-mentioned parts, in particular the shaft 50, its extension 72, the hollow shaft 62, the intermediate portion 68, the differential setting unit 76, the first coupling ring 80 and the second coupling ring 86 are arranged in substantially coaxial relationship. At its side towards the first coupling ring 80 the second coupling ring 86 is provided with a projection 88 which, for making a non-rotatable connection by positively locking interengagement between the two coupling rings 80 and 86, engages into one of three notches or recesses 90 which are disposed on the first coupling ring 80 around the periphery thereof at given angular spacings from each other. In that respect, the projection 88 and the recesses 90 are defined in such a way and are preferably of a conical configuration such that, when the projection 88 is disposed in one of the recesses 90, there is no play or clearance and that therefore gives the above-mentioned non-rotational connection, in other words, a rotational movement of the first coupling ring 80 produces a synchronous rotational movement of the second coupling ring 86 by way of the projection 88 engaging into the respective recess 90. The holder 82 carrying the pin 84 is fixed on the one hand to the extension 72 of the shaft 50 by way of a screw bolt 92. Furthermore the holder 82 is non-rotatably connected by way of a key or spline 93 to the extension 72 of the shaft 50 in order thereby to provide a play-free connection for the transmission of a torque.

When the two coupling members 80 and 86 are in engagement with each other and therefore are in the position shown in FIG. 8, the torque transmitted to the hollow shaft 62 by the gear 58 is transmitted by way of the intermediate portion 68, the differential setting unit 76 and the first coupling ring 80 to the second coupling ring 86 and from that by way of the pin 84 and the holder 92 to the shaft 50 on which the impression cylinder 37 is fixedly mounted. As the drive for the printing cylinder 36 is also derived from the gear 58 in the manner already described above, the two cylinders 36 and 37 with their peripheral surfaces adopt a given relative position with respect to each other, which is determined by the relative positions of the two coupling rings 80 and 86 with respect to each other and which is fixed by the positively locking engagement between the projection 88 and a respective recess 90 accommodating same.

In its lower region, at a spacing from the axis of rotation of the shaft 50 and its extension 72, the second coupling ring 86 which is connected to the extension 72 of the shaft 50 is provided with a recess 94 which serves as a seat for a coil spring 96. The latter bears with one end against the first coupling ring 80 which is provided with a pin 97 for holding and guiding the coil spring 96. The other end of the coil spring 96 presses against the inside of a cap 98 which closes the second coupling ring 86 at its side which is remote from the first coupling ring 80. By virtue of the second coupling ring 86 being subjected to a pressure force exerted by the coil spring 96 in that way, in the opposite direction to the direction indicated by the arrow 100 in FIG. 9, the second coupling ring 86 which is pivotable about the pin 84 is held in its operative position shown in FIG. 8 in which it is positively lockingly and thus non-rotatably connected to the first coupling ring 80 in the manner already described above, by means of the projection 88 engaging into one of the recesses 90 in the first coupling ring 80.

To afford the respectively required setting of the impression cylinder 37, the second coupling ring 86 is pivoted about the pin 84 from the position shown in FIG. 8 in the direction of the arrow 100 indicated in FIG. 9 into the position shown in FIG. 9. When that happens, the projection on the second coupling ring 86 comes out of engagement with the first coupling ring 80, as is clearly shown in FIG. 9, so that the non-rotatable connection between the two coupling rings 80 and 86 is disengaged. In order to permit the pivotal movements into the position shown in FIG. 9 the second coupling ring 86, in the region of the recess 94 accommodating the coil spring 96, at its side towards the first coupling ring 80, is provided with a bevel configuration 102 which results in the formation of a recess 103 into which the region of the first coupling ring 80 which is respectively disposed opposite the bevel configuration 102 engages when the second coupling ring 86 assumes the pivoted position as shown in FIG. 9, in which its longitudinal axis which in the position of FIG. 10 coincides with the axis of rotation of the shaft 50 and its extension 72 extends inclinedly relative to that axis of rotation. When the second coupling ring 86 is in the pivoted position, it is possible to rotate it in one direction or the other relative to the first coupling ring 80, as is indicated by the double-headed arrow 104 in FIG. 9. By virtue of the non-rotatable connection, relative to the axis of rotation of the impression cylinder 37, between the second coupling ring 86 and the pin 84 as well as the holder 82 carrying the latter on the extension 72, the holder 82 and therewith the impression cylinder 37 are entrained in the course of that rotational movement of the second coupling ring 86. As the second coupling ring 86 which is generally manually rotated for the purposes of the setting operation is in that case out of engagement with the first coupling ring 80, the impression cylinder 37 can be set in respect of its peripheral position relative to the peripheral position of the printing cylinder 36 and the printing blanket carried thereby, as the printing cylinder 36 does not take part in the rotational movement, because the two coupling rings 80 and 86 are disconnected from each other.

The first coupling ring 80 is provided with three notches or recesses 90 which are so distributed over the periphery of the first coupling ring 80 that they correspond to the three possible basic angular positions that the impression cylinder 37 can adopt relative to the printing cylinder 36, in the embodiment illustrated and described herein. Accordingly, when the projection 88 engages into one of the three notches 90, the impression cylinder 37 would assume the basic angular position shown in FIG. 10, in which the punch **48*b* engages into the cavity in the article being transported on the transport path 23, whereas the other two punches 48*a* and 48*c* are in inoperative positions. When the projection 88 engages into another of the three recesses 90 the impression cylinder 37 would assume relative to the printing cylinder 36 a basic angular position in which the two punches 48*a* and 48*b* each engage into a respective cavity of the pair of cards, in the printing operation. When a positively locking connection is made between the projection 88 and the third recess on the first coupling ring 80, the arrangement would then be in the third basic angular position of the impression cylinder 37 relative to the printing cylinder 38, in which, as shown in FIG. 12, none of the three punches 48*a*, 48*b* and 48*c* is in an operative position and thus cards without a cavity or with the cavity facing upwardly are printed upon, in both of the transport paths 23 and 24**.

It is therefore only necessary for the individual recesses 90 and therewith the basic angular position of the second coupling ring 86, which is required under the conditions which respectively apply in any given situation, relative to the first coupling ring 80, to be identified by for example indications provided on the first coupling ring, so that the basic angular position as is required for a given operating condition, as between the impression cylinder 37 and the printing cylinder 36, can be attained in two manipulation operations, namely firstly pivotal movement of the second coupling ring 86 into the position shown in FIG. 9 and thereafter rotation into the respectively desired basic angular position relative to the first coupling ring 80.

The differential setting unit 76 only serves in the usual way to permit the basic fine setting which is required to achieve the degree of accuracy which is usual nowadays, as between the impression cylinder 37 and the printing cylinder 36. After that fine setting has once been made, it is maintained in normal operation, independently of the respective basic position adopted, without involving further alterations. As therefore the differential setting unit 76 is not required for full understanding of the present invention, a detailed description thereof will not be set out herein.

The punches **48*a*, 48*b* and 48*c* are mounted radially displaceably within the impression cylinder 37** so that they can be axially accurately set relative to the respective cavity, in dependence on the depth thereof. This also involves a fine setting which, once it has been produced, is kept unchanged until there is a need to print on a new series of cards whose cavity is of a different configuration, or replacement of the punches is required for example due to wear or for other reasons.

Figure 14:
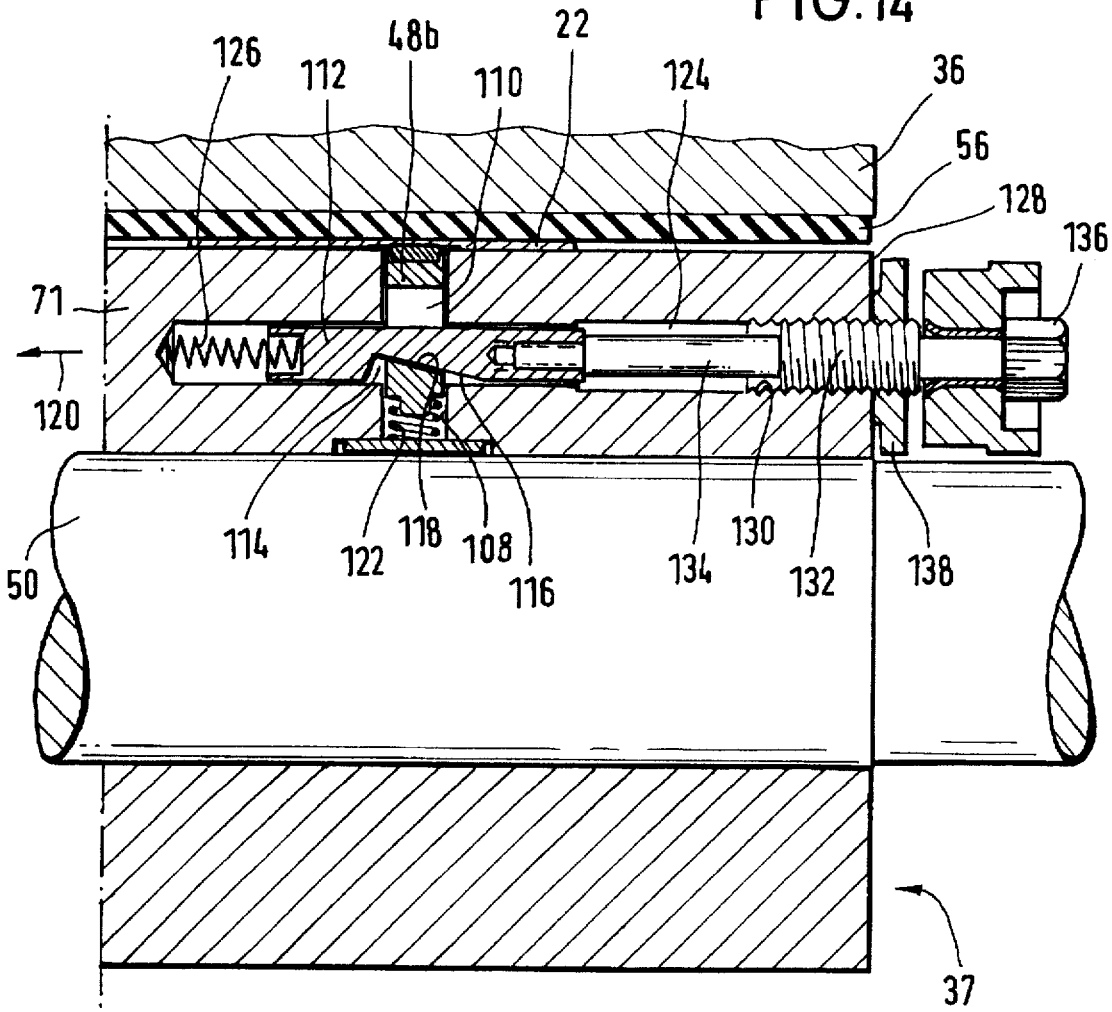
FIG. 14 is a view in section taken along line XIV—XIV in FIG. 10.

For that purpose, and reference is now made to FIG. 14, the impression cylinder 36 or the sector-shaped part 71 thereof is provided with a substantially radial bore 108 whose cross-section is of such a size that its peripheral surface forms a sliding guide for the illustrated punch **48*b*. The latter is provided with an opening 110 which extends substantially transversely to its longitudinal axis and through which there extends a pin 112 which is disposed substantially parallel to the axis of rotation of the impression cylinder 37. At its side which is towards the shaft 50 of the impression cylinder 37 the pin 112 is provided with a recess 114 delimited by an inclined surface 116. That inclined surface co-operates with an inclined surface 118 by which the opening 110 in the punch 48*b* is defined at its side which is towards the shaft 50. The two inclined surfaces 116 and 118 which extend substantially parallel to each other are so arranged in respect of their angle of inclination that, upon displacement of the pin 112 in the direction 9 of the arrow 120, the punch 48*b* is moved towards the shaft 50, that is to say away from the oppositely disposed printing cylinder 36. As the punch 48*b* is subjected to the force of a compression coil spring 122, at its end remote from the printing cylinder 36 and thus the article 22, a movement of the pin 112 in the opposite direction to the direction indicated by the arrow 120 results in axial displacement of the punch 48*b* under the force of the compression spring 122 in a direction towards the printing cylinder 26, such displacement being delimited by the position adopted by the inclined surface 116 of the pin 112. In that way, by means of simple displacement of the pin 112, it is possible accurately to set the respectively required radial position of the end region of the punch 48*b*, which engages into the cavity in the article or card, by means of axial displacement of the pin 112**.

The pin 112 is arranged in a bore 124 in the part 71 of the impression cylinder 37, the bore 124 extending substantially parallel to the shaft 50. The pin 112 is subjected to the force of a compression coil spring 126 acting in the opposite direction to the arrow 120 so that displacement of the pin 112 in that direction by the spring 126 results in axial displacement of the punch member **48*b* towards the shaft 50 and therefore away from the printing cylinder 36. The end portion of the bore 124, which is opposite to the coil spring 126 and which is open towards the end 128 of the impression cylinder 37, has at its peripheral surface a screwthread 130 into which a screwthreaded pin 132 is screwed from the outside. The end face of an extension portion 134 of the pin 112 bears against the end of the screwthreaded pin 132, which is towards the coil spring 126, under the pressing force applied by the coil spring 126. It is accordingly possible to determine the position of the punch 48*b* by suitable axial setting of the screw pin 132, as screwing the screwthreaded pin 132 into the bore 124 against the force of the coil spring 126 would result in axial displacement of the punch 48*b* towards the shaft 50 and rotation of the screwthreaded pin 132 in the opposite direction would result in displacement of the pin 112 in the opposite direction to the arrow 120 due to the force of the coil spring 126, and would thus result in the punch 48*b* being displaced towards the printing cylinder 36, under the force of the coil spring 122**.

The screwthreaded pin 132 is provided with an externally disposed actuating nut 136. A lock nut 138 locks the respectively set position of the screwthreaded pin 132 and thus the punch **48*b***.

The other two punches **48*a* and 48*c* are arranged in the same manner within the sector 63 which accommodates them, with the above-described setting arrangement being associated with each of the other two punches. The pin 112 for the punch 48*b* is actuated from the left-hand end, relative to the view shown in FIG. 8, of the impression cylinder 37 or the sector 63** thereof.

After the printing operation has been performed in the station III the cards are taken over by the two pairs of toothed belts 42, 43 already mentioned above and transported towards a main printing mechanism arranged in the station IV. There, the cards are provided with multi-color printing thereon. As however this is not directly related to the present invention there is no need for a detailed description of the main printing mechanism and the printing operation performed therein.

After having passed through the main printing station IV as indicated in FIG. 1, the cards pass through some drying stations before passing into a further offset printing station as indicated at V in FIG. 1, which is also a single-ink printing station similarly to the station III. For example a lacquer can be applied to the cards in the station V. In other respects the station V is of a similar design configuration to the station III, that is to say it also has a printing cylinder 36 and an impression cylinder 37 which corresponds in all parts to the impression cylinder shown in FIG. 3.

Thereafter the cards pass through a device as indicated at 140 in FIG. 1 in which the lacquer applied in station V drains off in order thereafter to pass through below two UV-driers 142.

Thereafter the cards can pass through a quality control station VI in which the quality of the printing is checked before they are then transferred to the collecting device 21. In that respect, depending on the circumstances involved, the procedure can be such that for example the cards on the one transport path, in which the first printing was applied, are transferred back to the beginning of the other transport path in order then for printing to be applied to the second side of the card.

It will be seen accordingly from the foregoing description that the above-described apparatus is such that it can be converted to different operating conditions in dependence on the nature of the respective articles to be printed upon and/or the nature of the respective side of an article, to which printing is to be applied, if at all necessary, without involving a great deal of time and if necessary also by ancillary personnel or operators of a relatively low level of skill, while nonetheless affording the required degree of accuracy. These considerations are also to apply when the apparatus is to be used for applying printing simultaneously to two or more articles which in that case are passed over a common impression cylinder. The described apparatus also takes account of the possibility that the same or different requirements are to be observed in relation to two articles which are to be simultaneously printed upon, in terms of the presence of a cavity or the position of a cavity therein. In this case also the apparatus permits rapid adaptive modification, without taking a great deal of time for that purpose. The structural means which are provided for those operations are simple and easy to operate.

It will be appreciated that the above-described apparatus has been set forth solely by way of example and illustration of the principles of the present invention and that various other modifications and alterations can be made therein without thereby departing from the spirit and scope of the invention.

What is claimed is:

1. Apparatus for printing on individual articles which each have an at least substantially flat surface to be printed upon and whose extent perpendicularly to said substantially flat surface is generally relatively small, comprising: a printing cylinder; an impression cylinder having at least one longitudinal portion with at least one substantially radial support portion which projects beyond the peripheral surface of the impression cylinder and which when printing on articles provided with at least one cavity with the side having the cavity towards the impression cylinder in an operative position engages into the cavity of the respective article passing the impression cylinder and supports its region defining the cavity; a drive means driving the impression cylinder and the printing cylinder; a disengageable coupling means rotatably connecting the impression cylinder to the drive means and having at least first and second coupling portions whereby when the coupling means is disengaged the impression cylinder is adjustable in respect of its rotary angular position relative to the rotary angular position of the printing cylinder; connecting means for the coupling portions of the coupling means operable in such a way that the coupling portions can be non-rotatably connected together in at least first and second predetermined basic angular positions corresponding to an operative and an inoperative angular position of the at least one support portion, the diameter of the impression cylinder being such that provided in the at least one longitudinal portion of the impression cylinder which is provided with the at least one support portion is a peripheral surface region which in the peripheral direction is of such a dimension that an article can pass the impression cylinder on that region of the peripheral surface without in that case coming into interfering contact with the at least one support portion.

2. Apparatus as set forth in claim 1 wherein for simultaneously printing on at least two articles using the same impression cylinder the latter is provided in each of at least first and second longitudinal portions with at least one respective support portion in such a way that the two support portions are disposed at a longitudinal spacing from each other substantially in the same radial plane which extends parallel to the axis of rotation of the impression cylinder and associated with the support portions is a common rotary angular position of the connecting means of the coupling portions.

3. Apparatus as set forth in claim 2 wherein the impression cylinder is provided in one of its longitudinal portions with a further said support portion and the spacing in the peripheral direction between the two support portions of the same longitudinal portion of the impression cylinder is so selected that the further support portion is disposed in a peripheral region of its longitudinal portion of the impression cylinder, to which there corresponds a peripheral region in the other impression cylinder longitudinal portion, in which an article can pass said impression cylinder longitudinal portion without coming into interfering contact with a support portion in said longitudinal portion, and associated with the basic angular position of the impression cylinder in which the further support portion assumes its operative position is a rotary angular position of the connecting means of the coupling portions.

4. Apparatus as set forth in claim 1 wherein the impression cylinder has at least first and second sector parts, at least one said support portion is associated with each sector part, and the support portions disposed in different sector parts assume different angular positions.

5. Apparatus as set forth in claim 4 wherein the impression cylinder has a shaft and the first and second sector parts are releasably mounted to the shaft of the impression cylinder.

6. Apparatus as set forth in claim 1 wherein the impression cylinder has a shaft and further including a hollow shaft which is coaxial with respect to the shaft of the impression cylinder and a drive means driving the hollow shaft, wherein a coupling portion is connected to the shaft of the impression cylinder and the other coupling portion is connected to the hollow shaft, one coupling portion is provided with at least one recess and the other coupling portion has a projection adapted to engage into the recess when the first and second coupling portions are non-rotatably connected together, the first and second coupling portions in the uncoupled condition being rotatable relative to each other and the at least one relative position between the first and second coupling portions which is fixed by the co-operation of the recess and the projection defining one of said basic angular positions of the impression cylinder with the at least one support portion relative to the printing cylinder.

7. Apparatus as set forth in claim 6 wherein the coupling portion connected to the shaft of the impression cylinder is pivotable relative to that shaft about an axis which extends substantially perpendicularly to the longitudinal axis of the shaft in order to release the rotational connection to the other coupling portion, in the position of being pivoted out of the normal operating position.

8. Apparatus as set forth in claim 7 wherein the coupling portion connected to the shaft of the impression cylinder is provided with at least one projection and the at least one recess with which the projection is brought into engagement to produce a non-rotatable connection is disposed on the coupling portion connected to the drive means.

9. Apparatus as set forth in claim 6 including a means for rotating the printing cylinder wherein the hollow shaft drivable by the drive means and connected to the first coupling portion drives the means for rotating the printing cylinder.

10. Apparatus as set forth in claim 1 wherein the at least one support portion is arranged displaceably in the direction of its longitudinal axis within the impression cylinder.

11. Apparatus as set forth in claim 10 wherein the at least one support portion is provided at a spacing from an end region thereof which engages into the cavity in the article with a recess which extends substantially transversely to its longitudinal direction, and further including a spring means acting on the support portion, a setting pin extending through said recess and disposed in a bore substantially parallel to the axis of rotation of the impression cylinder, the setting pin having an inclined surface co-operable with an inclined surface defining the recess in the support portion, in such a way that longitudinal displacement of the setting pin in one direction displaces the support portion against the force of the spring means acting thereon, towards the axis of rotation, and displacement of the setting pin in the opposite direction permits a movement of the support portion in the opposite direction under the force of the spring means acting thereon.

12. Apparatus as set forth in claim 11 including means for setting the setting pin disposed at the end of the impression cylinder and including a screwthread means for producing the longitudinal movement of the setting pin.

13. Apparatus as set forth in claim 1 including at least an article transport path, a shaft carrying the impression cylinder, a bolder mounting the impression cylinder shaft and adapted to be movable upwardly and downwardly, a monitoring means for controlling the holder and adapted to check for the presence of at least one article in the at least one transport path and operable when an article is present to check the position and orientation of the article and ejector means controlled by the monitoring means for ejecting incorrectly disposed articles from the transport path, the monitoring means also being operable to control the position of the impression cylinder in dependence on the result of the monitoring operation in such a way that in the absence of at least one article the impression cylinder is lowered when an empty position corresponding to a missing article reaches the printing cylinder and the impression cylinder.

14. Apparatus as set forth in claim 13 including for simultaneously printing on first and second articles first and second transport paths for transporting the articles into the region in which the printing operation takes place, wherein the monitoring means is operable to monitor the first and second transport paths and when an article of a pair thereof is missing to eject the other article by operating the ejector means.

* * * * *